United States Patent [19]

Strain

[11] Patent Number: 4,478,165

[45] Date of Patent: Oct. 23, 1984

[54] BALLAST-CARGO GRID SYSTEM FOR TANKERS

[76] Inventor: Patrick J. Strain, 27 Tanglewood Dr., Nepean, Ontario, Canada, K2H 6P5

[21] Appl. No.: 476,665

[22] Filed: Mar. 18, 1983

Related U.S. Application Data

[63] Continuation-in-part of Ser. No. 234,135, Feb. 13, 1981, abandoned.

[30] Foreign Application Priority Data

Apr. 11, 1980 [CA] Canada ..... 347444

[51] Int. Cl.[3] ..... B63B 25/12

[52] U.S. Cl. ..... 114/74 R

[58] Field of Search ..... 114/74 R, 74 A, 74 T, 114/125, 256, 257; 220/22, 22.1, 85 B, 404, 461, 901; 405/205, 210

[56] References Cited

U.S. PATENT DOCUMENTS

| | | | |
|---|---|---|---|
| 2,584,953 | 2/1952 | Wiggins | 220/85 B |
| 3,326,167 | 6/1967 | Paoli | 114/125 |
| 3,477,401 | 11/1969 | Hayama | 114/74 A |
| 3,707,937 | 1/1973 | Liles | 114/74 A |
| 4,098,297 | 7/1978 | Zahid | 220/85 B |
| 4,117,796 | 10/1978 | Strain | 114/74 R |

FOREIGN PATENT DOCUMENTS

| | | | |
|---|---|---|---|
| 1059310 | 6/1959 | Fed. Rep. of Germany | 114/74 A |
| 53-147386 | 12/1978 | Japan | 114/125 |

*Primary Examiner*—Trygve M. Blix
*Assistant Examiner*—Jesus D. Sotelo
*Attorney, Agent, or Firm*—William A. Drucker

[57] ABSTRACT

A plurality of narrow ballast tanks arranged around the periphery of diaphragms. The peripheral ballast tanks facilitate the construction, installation, operation, and maintenance of the diaphragms that segregate the cargo oil from the ballast water in the oil tanker in which they are fitted. The peripheral ballast tanks in general are built along the longitudinal and transverse bulkheads and ship's sides, but they can also be arranged to subdivide the lower portion of large cargo tanks, they, in effect, form a tank grid about the lower portion of the cargo tanks' space, with the cells in the grid being suitable for the reception of the diaphragms. The diaphragms each consist of three main parts: a vertically movable thin and flat partition, that can be buoyant in order that it may float on ballast water; a mating but fixed partition rim fitted outside of the movable partition; and elastomeric membrane sheet that is fitted between and attached to the movable partition in such a manner that the complete diaphragm forms an impervious barrier to oil or water attempting to pass from top to bottom or vice verse. A movable partition guide is also provided. By locating the fixed partition rim at midpoint of the movable partition travel on the sides of the peripheral ballast tanks, major savings of membrane material can be achieved.

6 Claims, 6 Drawing Figures

BALLAST-CARGO GRID SYSTEM FOR TANKERS

This application is a continuation-in-part of application Ser. No. 234,135, filed Feb. 13th, 1981 now abandoned.

BACKGROUND OF THE INVENTION

International maritime agreements require that most new oil tankers have to be fitted with a system capable of keeping the cargo oil and ballast water, including their residues, physically apart at all times, i.e. a segregated ballast system must be fitted.

The inventor's U.S. Pat. No. 4,117,796 "Double Sectioned Tank" discloses a means whereby segregation of the cargo oil and ballast water is achieved without most of the very substantial loss of cargo carrying capacity necessitated by the standard method of using entirely separate tanks to contain each of the two substances.

The present invention relates generally to improvements to the aforesaid U.S. Patent. The improvements make unnecessary certain items in the patent and will facilitate the manufacture, installation, operation, and maintenance of the diaphragms disclosed in the patent, while also providing means whereby the hull girder strength may be improved. The provision of ballast tanks located low down in a tanker fitted with the improvements may also increase seakeeping and ship stability performance by reducing stiffness in the cargo loaded condition.

It will be noted that a standard segregated ballast oil tanker will have to designate capacity equivalent to approximately one-third of it's cargo capacity to the carriage of segregated ballast. In the cargo loaded condition this space will be filed with air, i.e. the tanker will carry only approximately two-thirds of the cargo it would be capable of carrying if it were an ordinary non-segregated ballast tanker.

A segregated ballast tanker that is fitted with the present invention will utilize a large proportion of the designated ballast space to carry revenue generating cargo.

PRIOR ART

U.S. Pat. No. 4,117,796 of Strain, describes a special type of tank that can be built into the cargo tanks of an oil tanker and which, by the use of movable semi-solid steel and reinforced elastomeric diaphragms, can allow for the carriage of cargo oil in portion of the empty ballast tanks, without any product cross-contamination, i.e. it provides fully segregated ballast space, while allowing for greater cargo carrying capability than an identical externally dimensioned standard ballast tanker. It also allows for the provision of protective segregated ballast double bottom space in the cargo loaded condition.

U.S. Pat. No. 3,477,401 of Hayama illustrates a submarine fitted with a flexible bag or membrane to segregate oil from ballast water in the hull of the vessel.

U.S. Pat. No. 2,696,185 of Snoddy discloses a horizontal membrane cargo oil segregation system.

U.S. Pat. No. 3,943,873 of Hering and Schwartz depicts a vertical membrane cargo oil/ballast water segregation system for an oil tanker.

U.S. Pat. No. 3,707,937 of Liles describes a collapsible container for segregating cargo oil and ballast water in an oiler tanker.

U.S. Pat. No. 3,922,985 of Hamilton teaches a system whereby expansible bladders are used to contain cargo oil while an outer steel compartment is designed to carry segregated ballast water.

U.S. Pat. No. 3,745,960 of Devine shows an oil tanker having a particular arrangement of bulkheads and tanks wherein there is a minimum of metal exposed to corrosive fluids.

SUMMARY OF THE INVENTION

Special narrow ballast tanks are arranged around the periphery of the semi-solid diaphragms disclosed in the inventor's U.S. Pat. No. 4,117,796 "Double Sectioned Tank". The narrow tanks will usually have a height equal to the maximum upper travel position of the diaphragm, plus the height of double bottom space required. By making the narrow tanks on the ship's side at least the required minimum width, they will provide "protective ballast space" for the cargo oil tanks, as will the double bottom tanks if they are at least the required minimum height.

The narrow ballast tanks generally follow the contours of, and can be built as part of, an oil tanker's main longitudinal and transverse bulkheads, and the ship's sides. In cases where it is decided to sub-divide the main cargo tanks to facilitate installation of the diaphragms, the narrow tanks can be used as dividers. The lower portion of the narrow ballast tanks can extend to, or into, the "double bottom" ballast space and they can be made common with, or separated from, this space as desired.

A diaphragm consists of three main parts, (a) a vertically movable thin flat solid or compartmentalized partition that may be of steel, or equivalent material;

(b) a fixed thin flat solid partition rim that may also be of steel, or equivalent material; and (c) a thin flexible membrane sheet of reinforced elastomeric material the properties of which include resistance to abrasion and tearing and which is also compatible with sea water, hot and cold crude and other oils and chemicals.

Fastenings, guide, and safety means are also provided as disclosed in U.S. Pat. No. 4,117,796, "Double Sectioned Tank".

By using oiltight/watertight fastenings to join one end of a membrane to a movable diaphragm partition, and the other end of the membrane to a fixed partition rim, and attaching the latter, at the position of movable partition mid-travel, to the sides of a particular set of peripheral ballast tanks, a fully segregated cargo oil/ballast water system is obtained, while allowing that portion of cargo tank space through which the movable partition travels to carry, at a particular time, either cargo oil or ballast water without any cross-contamination between the substance occupying that space, and the residues and vapours from the substance that previously occupied that space.

The following major advantages are commensurate with the invention as claimed:

1. A tanker fitted with the invention will carry substantially more cargo than an identical externally dimensioned standard segregated ballast tanker.

2. Only approximately half of the amount of membrane material (U.S. Pat. No. 4,117,796, Item No. 18 "fabric sheet") will be required - resulting in easier manufacture, handling, installation, and maintenance of the membranes, and also lowering their cost.

3. The substantially smaller amount of membrane material required will result in a simpler and less complicated system for practical shipboard operation.

4. The strips of elastic material or springs (U.S. Pat. No. 4,117,796, Item No. 20 "elastic material or springs") for guiding the membranes are made unnecessary in most cases.

5. The straight sides of the peripheral ballast tanks will provide ideal support for the diaphragms and make diaphragm support plates (U.S. Pat. No. 4,117,796, Item No. 100 "fabric sheet support plates") unnecessary in most cases.

6. Strength can be built into the peripheral ballast tanks to help compensate for the internal steelwork removed to allow space for the installation and operation of the diaphragms.

7. The peripheral ballast tank grid system will provide extra longitudinal and transverse strength for the tanker's hull.

BRIEF DESCRIPTION OF THE DRAWINGS

To maintain simplicity, various features that are essential to the safe and efficient operation of the diaphragms (e.g. detailed diaphragm guide and locking arrangements), and which have already been disclosed in the invention U.S. Pat. No. 4,117,796 "Double Section Tank", are not repeated in the following drawings. However, it will be understood that those various features are integral to the following drawings and will be included as necessary when the disclosures of the drawings are transmitted into practice.

Other objects and advantages of the invention will become apparent upon reading the following detailed description and upon referring to the drawings in which.

In the drawings like characters of reference designate similar parts in the several Figures.

DETAILED DESCRIPTION OF THE INVENTION

Figure 1:
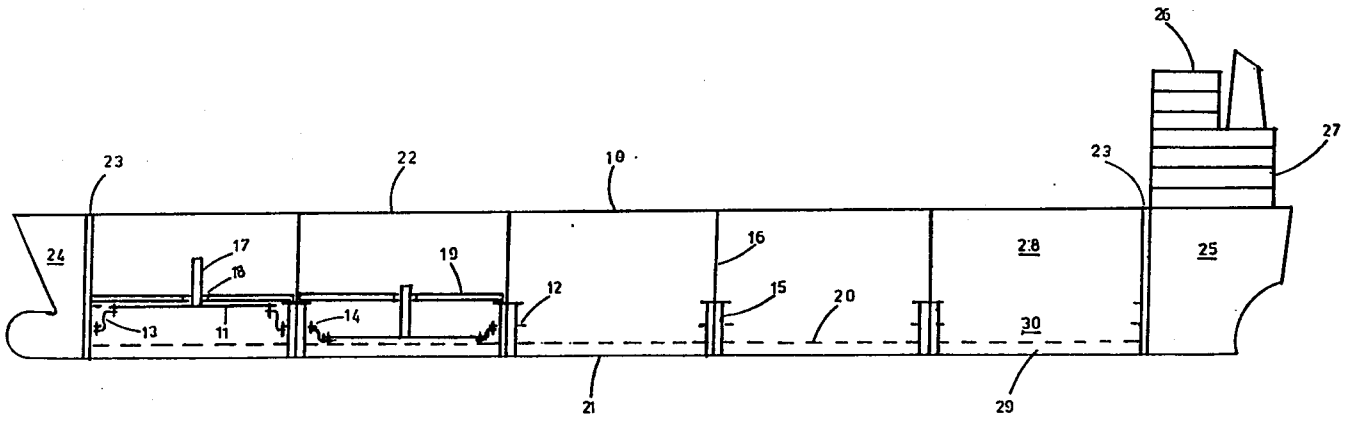
FIG. 1 is a longitudinal cross-sectioned elevation of a tanker that is fitted with the improved type of segregation diaphragms in its cargo tanks.

While the invention will be described in connection with example embodiments, it will be understood that it is not intended to limit the invention to those embodiments. On the contrary, it is intended to cover all alternatives, modifications, and equivalents, as may be included within the spirit and scope of the invention as defined by the appended claims.

For reasons of clarity, emphasis throughout this detailed description will be placed on the invention as applied to oil tankers, but it will be understood that the invention, with slight and obvious modification is also suitable for use in chemical carriers, liquified gas carriers, other liquid carriers, and cargo ships, and for other uses outside the shipping industry.

Also should the shipowner so wish, with slight and obvious modification a diaphragm can be placed in the side of a tank, i.e. with the movable partition 11 and attachments in a vertical positon.

Cargo and ballast tank filling and emptying arrangements are conventional and are not depicted in the drawings.

Referring to FIG. 1, this depicts an oil tanker 10 that is fitted with the present invention. Segregation diaphragms, the purpose of which is to segregate the cargo oil from the ballast water, are fitted in the cargo tanks of the oil tanker 10. Each segregation diaphragm consists of a movable partition 11, a partition rim 12 which is fixed, and a reinforced elastomeric membrane 13 that has its ends attached by suitable means, which may be clamp-bars and bolts 14, to the movable partiton 11 and the fixed partition rim 12.

Peripheral ballast tanks 15 are located around the outside of the segregation diaphragms, and the partition rims 12 are fitted, usually by welding, to those sides of the peripheral ballast tanks 15 that face the movable partitions 11, and generally at the position of movable partition 11 mid-travel. The peripheral ballast tanks 15 depicted are built on either side of the transverse bulkheads 16, which they help to strengthen, and by means of holes cut in the bulkheads can be made common, or kept separated, to the shipowner's requirements. The longitudinal ballast tanks 15 are not shown in this drawing for reasons of clarity.

A guide cylinder 17, or other guide means, is fitted to each movable partition 11, and a guide bearing 18 and bearing beam 19, are fitted to constrain the movable partition 11 to movement in a vertical direction only. This movable partition 11 movement is confined to the space between the bearing beam 19 and the bottom frames 20 or the internal structure of the oil tanker 10. The ship's bottom 21 may need to be reinforced to help compensate for steelwork removed in order to make space for the diaphragms.

The ship's main deck 22, cofferdams 23, fore peak 24, machinery space 25, bridge 26, and accommodation 27, are conventional.

A diaphragm, together with its fittings and peripheral ballast tanks 15, forms an impermeable barrier to oil and water, and transforms a tank in which it is fitted into four distinct spaces, each with its own function, namely;

(a) peripheral ballast tanks 15 space, dedicated to segregated ballast;

(b) dedicated cargo oil space 28, located above the maximum height of travel of the movable partition 11;

(c) dedicated segregated ballast space 29, or double bottom space, located above the hull bottom plating 21 and below the minimum height of travel of the movable partition 11; and (d) diaphragm space 30, located between the peripheral ballast tanks 15, with its height extending from the tops of the bottom frames 20, i.e. lowest position of movable partition 11 travel, to the maximum height of the peripheral ballast tanks 15, i.e. highest position of movable partition 11 travel, and, depending on which mode the tanker is functioning in at a particular time, it will either contain cargo oil or clean ballast water, as decided by the position of the diaphragm, i.e. with the movable partition 11 in the lower position it will contain cargo oil, and with the movable partition 11 in the raised position it will contain clean ballast water, without any cross-contamination of the two substances, their residues or vapours.

It will be noted that all cargo oil carried in the diaphragm spaces 30, is additional to that which may be carried in a conventional segregated ballast tanker with identical external dimensions.

Figure 2:
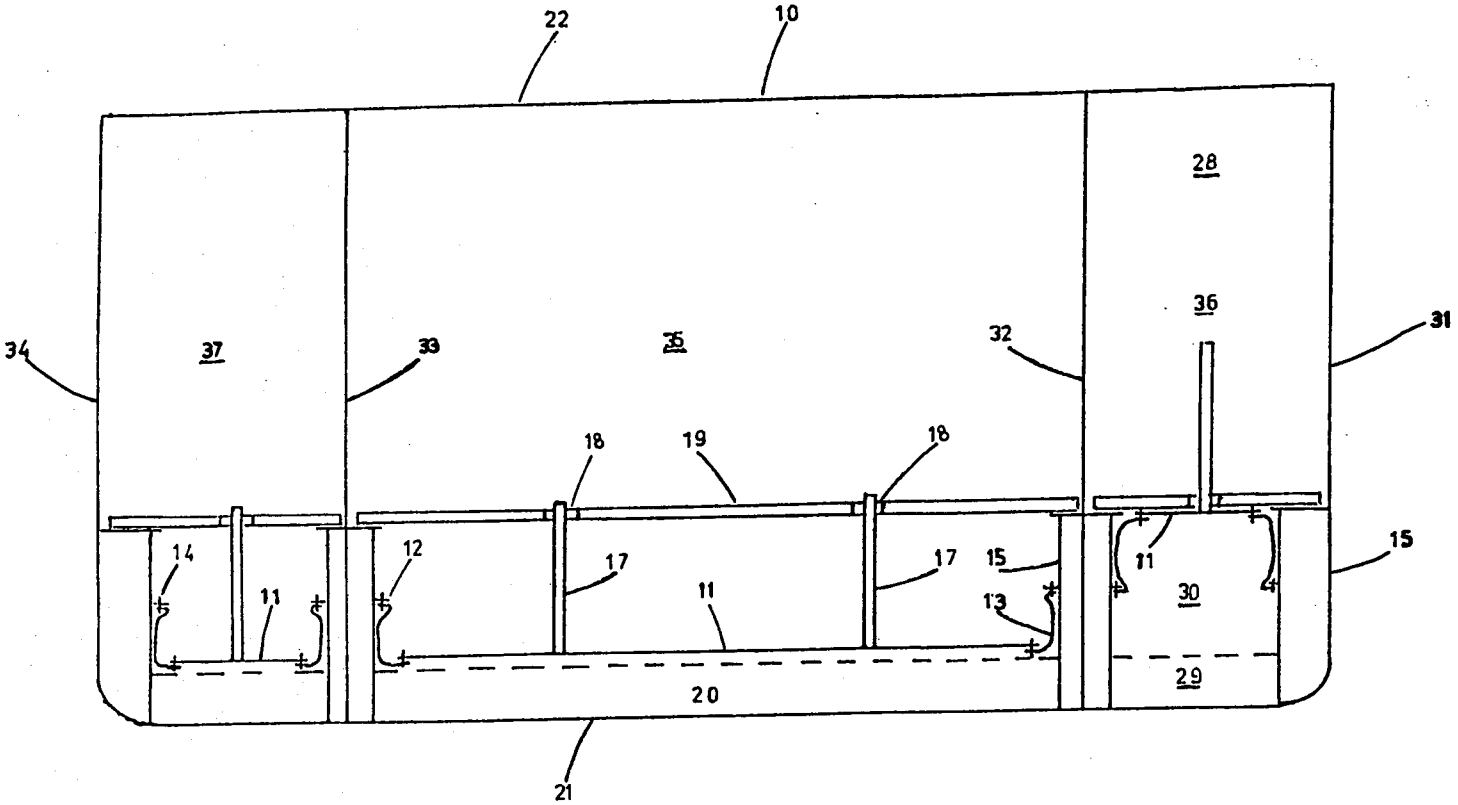
FIG. 2 is a transverse cross-sectioned elevation of the hull of the tanker in FIG. 1 at mid-length, and showing the cargo tanks and ballast tanks arrangement.

Referring to FIG. 2, this shows a large diaphragm fitted in a centre cargo tank 35 of the oil tanker 10 of FIG. 1. Smaller diaphragms are fitted in the port wing tank 36 and the starboard cargo wing tank 37. Peripheral ballast tanks 15 are built along the tanker's port side 31, port longitudinal bulkhead 32, starboard longitudinal bulkhead 33, and starboard ship'side 34. The transverse peripheral ballast tanks 15 are not shown in this Figure.

The port wing tank diaphragm is depicted in the raised, i.e. ballast position, and the centre tank and wing tank diaphragms are shown in the lowered, i.e. cargo loaded position. When the diaphragms are in the raised position, the peripheral ballast tanks 15, are also filled with ballast water. These tanks are empty when the diaphragms are in the lowered position and the cargo is on board.

The additional guide cylinder 17 fitted to the centre movable partition 11, provides extra guide means to help cope with the large weight of movable partition 11 material involved.

The longitudinal and transverse peripheral ballast tanks 15, can, according to the shipowner's requirements, be designed for internal fluid communication with one another and also with bottom frame space 29, including diaphragm space 30 when the tanker is in the ballast mode of operation.

Figure 3:
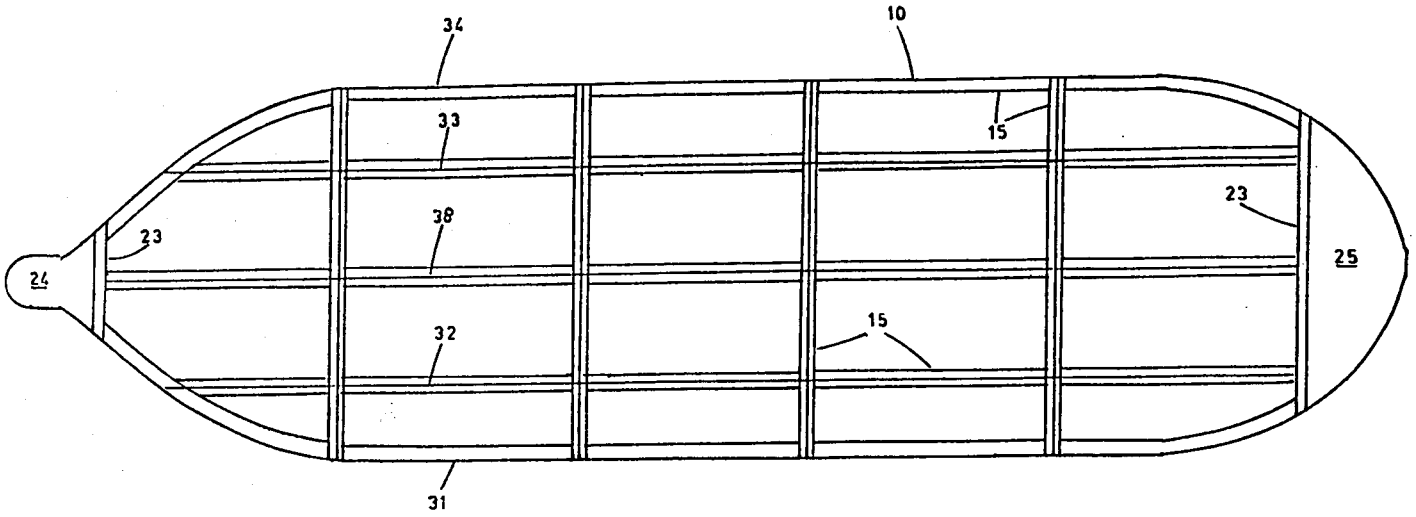
FIG. 3 is a plan view of the peripheral ballast tank grid system as applied to a tanker similar to that depicted in FIG. 1, except that three longitudinal bulkheads are fitted.

Referring to FIG. 3, this is a plan view of the peripheral ballast tanks 15 in a V.L.C.C. similar to but larger than the tanker depicted in FIGS. 1 and 2. To further sub-divide the cargo tank spaces, and to provide extra hull strength, an additional longitudinal bulkhead, the centre longitudinal bulkhead 38, is fitted.

It will be noted that the peripheral ballast tanks 15, together with the cofferdams 23, and other tanks such as bunker or small water tanks that may be incorporated, form a tank grid with cells suitably located to facilitate the installation and operation of the cargo oil/ballast water segregation diaphragms, by providing solid smooth flat support surfaces for the reinforced elastomeric membranes 13 (FIG. 2).

Those peripheral ballast tanks 15, that are located at the tanker's 10 sides, if of suitable width, will also provide protective ballast space for the adjacent loaded cargo tanks. The double bottom space 29 (FIG. 4), if of sufficient height, will also fulfill a similar function for its adjacent cargo oil tanks.

Figure 4:
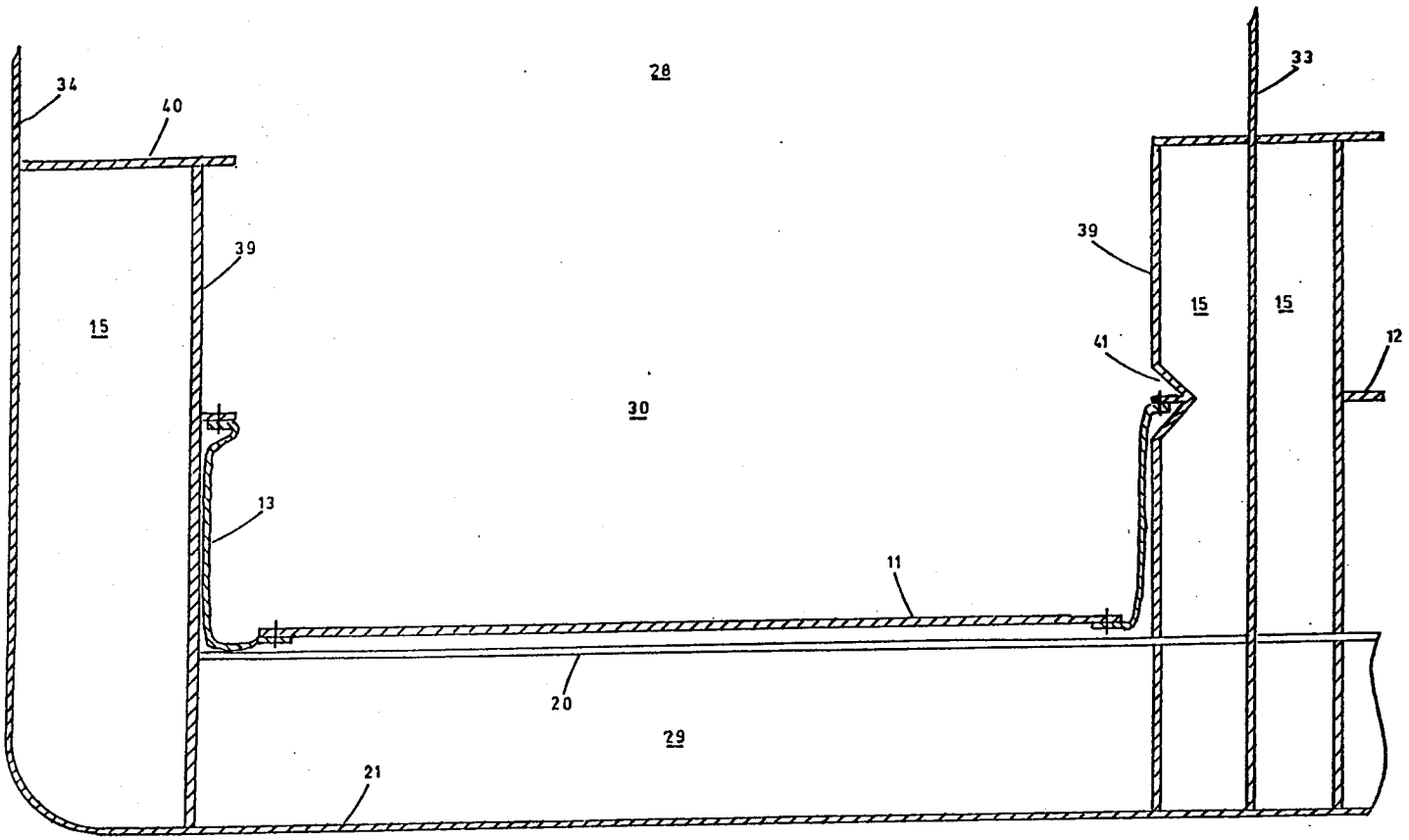
FIG. 4 is a transverse cross-sectional elevation of a starboard cargo/ballast tank arrangement showing different methods of partition rim attachment.

Referring to FIG. 4, this shows various constructional details of the diaphragms and of the peripheral ballast tanks 15. Two different methods for locating the fixed partition rim 12 on the sides of the peripheral ballast tanks 15 are depicted.

On the starboard ship's side peripheral ballast tanks 15, the partition rim 12 is attached, usually by welding, to the straight inner side plating 39 of the tank at movable partition 11 mid-travel position. The top plating 40 of the side tank is extended, by an amount greater than the width of the partition rim 12, towards the movable partition 11, and forms an overlap of the tank side 39 to allow a mating fit between the movable partition 11 in its raised (ballast) position and the peripheral tank top 40, this will help to prevent ballast water sloshing with possible membrane 13 damage and will also facilitate movable partition 11 securing means.

On the peripheral ballast tank 15 that is attached to the starboard longitudinal bulkhead 33, a recess 41 is made in the inner side plating 39 that is facing the movable partition 11, and the fixed partition rim 12 is fitted in the recess 41. This will allow the side of the movable partition 11 to be located nearer to the side plating 39 of the peripheral ballast tank 15, with only a small, or no overlap by top plating 40, thereby attaining the same advantages as the first method described above of the partiton rim 12 attachment.

For light movable partitions 11, guide and securing means may be waived, as depicted in this Figure, but for heavier movable partitions 11, guide and securing means, as disclosed in U.S. Pat. No. 4,117,796 "Double Sectioned Tank", are essential.

Figure 5:
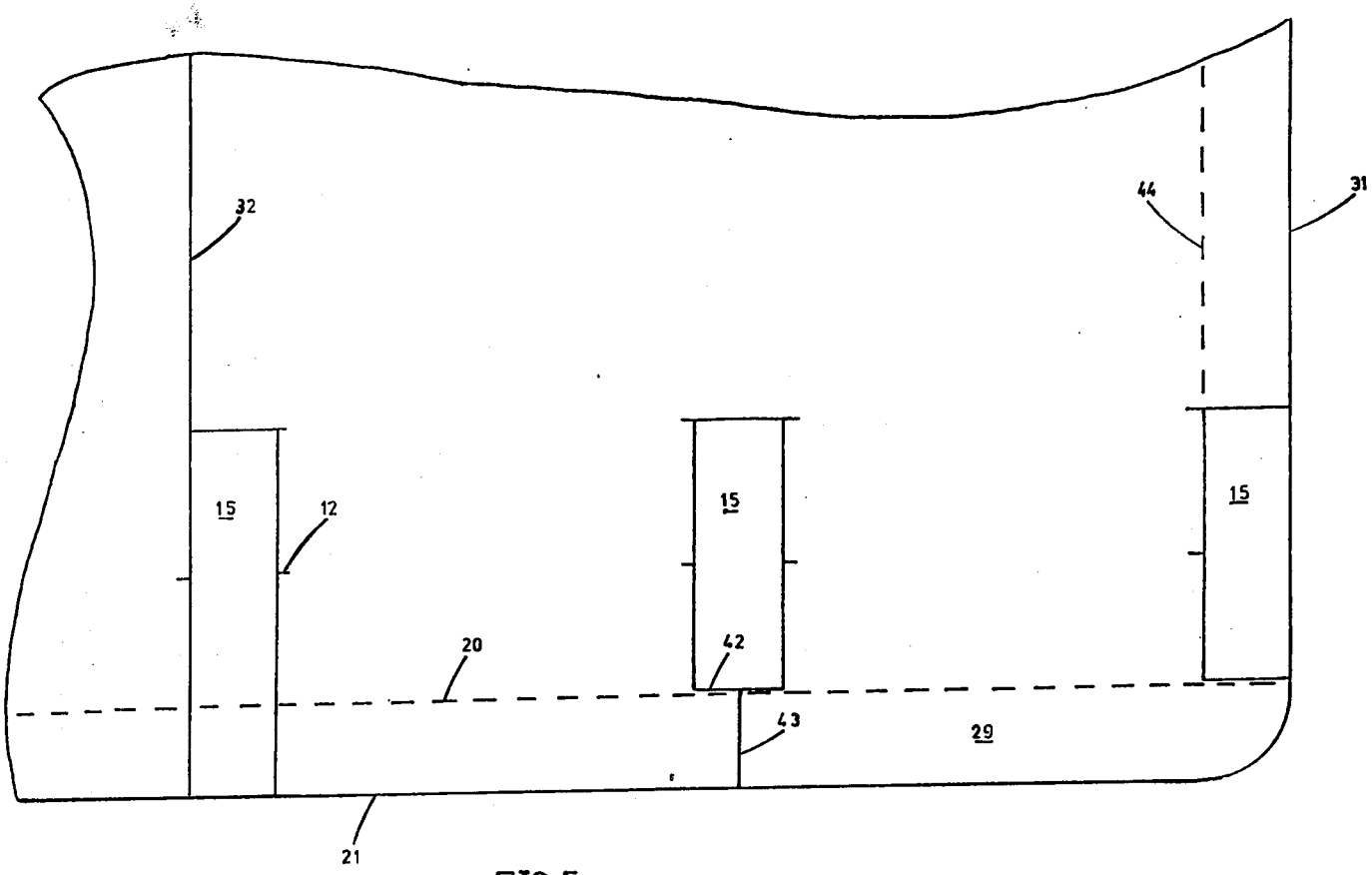
FIG. 5 is a transverse cross-sectional elevation of a port wing cargo tank depicting a different peripheral ballast tank arrangement and constructional features to those arrangements and features shown in the preceding Figures.

Referring to FIG. 5, wherein different methods of construction and arrangement of the peripheral ballast tanks 15 are depicted. In the arrangement as shown the lower portion of a large cargo oil tank is divided into smaller portions for convenience in diaphragm manufacture, installation, operation and maintenance.

The inner peripheral ballast tank 15 is built against the side of the port longitudinal bulkhead 32. The centre peripheral ballast tank 15 rests on and is attached to the bottom frames 20, and has its own integral bottom plating 42, instead of the ship's bottom plating 21. The outer peripheral ballast tank 15, that is built against the ship's port side 31 has a similar integral bottom. An intercostal 43 is fitted to divide the double bottom space 29 and to provide peripheral ballast tank 15 support and extra hull strength.

The inner partition rim 12 is attached directly to the port longitudinal bulkhead 32.

The port side frames 44 are conventional. The diaphragms, other than the fixed partition rims 12, and the transverse peripheral ballast tanks are not shown in this drawing.

Figure 6:
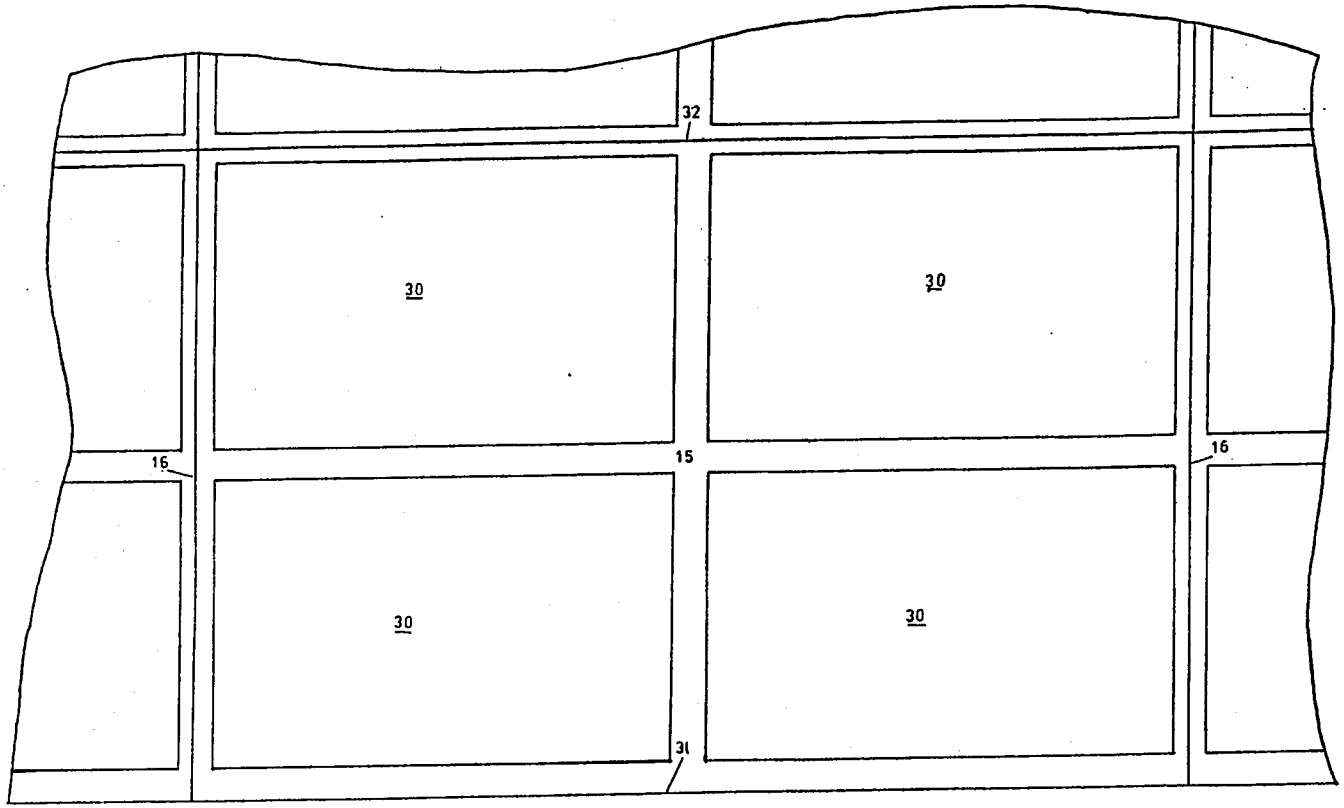
FIG. 6 is a plan view of a peripheral ballast tank grid arrangement that divides the lower portion of a large cargo tank into four spaces, or cells, each of which is suitable for the reception of a diaphragm.

Referring to FIG. 6, wherein the lower portion of a large cargo oil tank is divided into four diaphragm spaces (or cells) 30 by the peripheral ballast tank 15, which follows the contours of the main longitudinal 16 and transverse 32 bulkheads and acts as a division of the space between the bulkheads and the ship's port side 31.

In this drawing the peripheral ballast tank arrangement is depicted as one continuous ballast tank, but it will be understood that in practice this tank can be divided to suit the shipowner's ship stability and operational requirements. Also by suitable peripheral ballast tank arrangement, more, or less, than four diaphragm spaces 30 can be provided in each cargo tank to the shipowner's requirements.

While certain novel features of my invention have been shown and described and are pointed out in the appended claims, it will be understood that various substitutions, omissions and changes in the forms and details of the device illustrated and in its operation can be made by those skilled in the art without departing from the spirit of the invention. Therefore what has been set forth is intended to describe and/or illustrate such concept and is not for limiting protection to any herein particularly described embodiment thereof.

What I claim as my invention:

1. A ballast-cargo grid system for a tanker or the like comprising, within the length of the cargo space of the hull of the tanker, a plurality of narrow ballast tanks generally following the contours of the ship's sides and of the main longitudinal and transverse bulkheads, to form a grid pattern of rectangular or square vertical hollow cells with straight smooth sides of a height generally reaching from the ship's bottom up to half of the cargo space height, wherein each individual cell contains therewithin a segregation partition in the form of diaphragm means, cargo space of the hull being divided into a plurality of individual cargo spaces, and wherein the narrow ballast tanks also extend crosswise and lengthwise through individual cargo spaces to further subdivide such cargo spaces into smaller individual cargo spaces.

2. A ballast-cargo grid system according to claim 1, further wherein said ballast tanks are located peripherally in relation to the edges of the diaphragm means, the diaphragm means comprising a vertically movable rigid partition located across and along said individual cell in such manner that physical clearance is provided all around between the partition edges and the surrounding sides of said narrow ballast tanks forming the cells, for passage of an elastomeric membrane skirt, one end of which is sealingly attached all around to the perimeter of the partition and the other end of which is horizontally sealingly attached all around to the sides of the cell, generally at partition mid-travel position to form a diaphragm which presents an impervious barrier to liquid attempting to pass from that portion of the cell which is above the diaphragm at a particular time to that portion of the cell which is below the diaphragm at the same time and vice versa.

3. A ballast-cargo grid system according to claim 2 wherein guide and securing means for the diaphragm is provided solely by the contours of the sides of the peripheral ballast tanks which face towards the diahragm.

4. A ballast-cargo grid system according to claim 2 wherein a guided means is provided for the movable partition consisting of a beam with a bearing generally located at its centre, which is placed across the top of the cell in such manner that each end of the beam rests on and is fixedly attached to the top plating of a narrow peripheral ballast tank, with the two tanks being located at opposite sides to one another in relation to the cell, and with a guide cylinder one end of which is fixedly attached to the top of the movable partition, having its other end passing through the bearing in the beam in such manner that the movable partition is guided at all times during its travel from top to bottom of the cell and vice versa.

5. A ballast-cargo grid system according to claim 1 wherein some of the narrow peripheral ballast tanks are attached to the ship's hull in such a manner that part of the hull is integral with and forms the bottom and sides of those narrow ballast tanks.

6. A ballast-cargo grid system according to claim 1 wherein the construction of the ballast tanks is separate and distinct from that of the ship's hull.

* * * * *